US010093108B1

(12) United States Patent
Giacobbi et al.

(10) Patent No.: US 10,093,108 B1
(45) Date of Patent: Oct. 9, 2018

(54) SYSTEM AND METHOD FOR ATTENUATING OXYGEN INHIBITION OF ULTRAVIOLET INK CURING ON AN IMAGE ON A THREE-DIMENSIONAL (3D) OBJECT DURING PRINTING OF THE OBJECT

(71) Applicant: Xerox Corporation, Norwalk, CT (US)

(72) Inventors: James L. Giacobbi, Penfield, NY (US); Matthew R. McLaughlin, Rochester, NY (US); Victoria L. Warner, Caledonia, NY (US); Richard A. Campbell, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/636,012

(22) Filed: Jun. 28, 2017

(51) Int. Cl.
*B41J 2/20* (2006.01)
*B41J 11/00* (2006.01)
*B41J 3/407* (2006.01)

(52) U.S. Cl.
CPC ..... *B41J 2/20* (2013.01); *B41J 3/4073* (2013.01); *B41J 11/002* (2013.01)

(58) Field of Classification Search
CPC ..... B41J 2/20; B41J 11/002; B41J 3/4073
See application file for complete search history.

(56) References Cited

U.S. PATENT DOCUMENTS

| | | | | |
|---|---|---|---|---|
| 8,950,322 | B2 | 2/2015 | Liu et al. | |
| 9,032,874 | B2 | 5/2015 | Liu et al. | |
| 2009/0305515 | A1 | 12/2009 | Ho et al. | |
| 2013/0293652 | A1* | 11/2013 | Spence | B41J 3/28 347/104 |
| 2015/0283830 | A1* | 10/2015 | Edlitz | B41J 11/002 347/21 |
| 2015/0309413 | A1 | 10/2015 | Liu et al. | |
| 2016/0311226 | A1* | 10/2016 | Bradway | B41J 2/16544 |

OTHER PUBLICATIONS

Jo Ann Arceneaux; Mitigation of Oxygen Inhibition in UV LED, UVA, and Low Intensity UV Cure; UV+EB Technology; 2014; 11 Pages; Allnex Belgium SA.

* cited by examiner

*Primary Examiner* — Henok Legesse
(74) *Attorney, Agent, or Firm* — Maginot Moore & Beck LLP

(57) ABSTRACT

A direct-to-object printer includes a vaporizer to attenuate the effect of oxygen inhibition on the curing of non-aqueous ultraviolet (UV) marking material ejected onto the surface of an object printed by the printer. The vaporizer includes a heating element to form a vapor from a solution of solvent and particulate and a pressurized air source to direct the vapor toward the object to enable a portion of the vapor to condense on the object. The condensed vapor forms a barrier that attenuates the effect of oxygen inhibition on the curing of non-aqueous UV marking material.

17 Claims, 3 Drawing Sheets

SYSTEM AND METHOD FOR ATTENUATING OXYGEN INHIBITION OF ULTRAVIOLET INK CURING ON AN IMAGE ON A THREE-DIMENSIONAL (3D) OBJECT DURING PRINTING OF THE OBJECT

TECHNICAL FIELD

This disclosure relates generally to a system for printing on three-dimensional (3D) objects, and more particularly, to systems that print images on 3D objects with ultraviolet (UV) curable inks.

BACKGROUND

Commercial article printing typically occurs during the production of the article. For example, ball skins are printed with patterns or logos prior to the ball being completed and inflated. Consequently, a non-production establishment, such as a distribution site or retail store, for example, in a region in which potential product customers support multiple professional or collegiate teams, needs to keep an inventory of products bearing the logos of various teams popular in the area. Ordering the correct number of products for each different logo to maintain the inventory can be problematic.

One way to address these issues in non-production outlets is to keep unprinted versions of the products, and print the patterns or logos on them at the distribution site or retail store. Printers known as direct-to-object (DTO) printers have been developed for printing individual objects. These DTO printers have a plurality of printheads arranged in a vertical configuration with one printhead over another printhead. Some of these printers use UV curable inks to form ink images on the objects. UV curable inks require a UV radiation source that directs UV light onto the inks on the object surface. This light cures the inks and helps eliminate vapors that otherwise emanate from the inks. Some of these vapors can be noxious to humans.

One issue that affects the ability of the UV curing device to cure the UV curable inks is oxygen inhibition. Oxygen inhibition refers to the effect of atmospheric diatomic oxygen being present at the ink image as the UV light impinges on the image. Specifically, the oxygen affects the free radicals in the chain reactions that result in the curing of the UV inks. Methods for addressing oxygen inhibition are identified in Table 1 of "Mitigation of Oxygen Inhibition In UV LED, UVA and Low Intensity UV Cure" by Jo Ann Arceneaux, Ph. D., Allnex USA Inc., which was presented at uv.eb WEST 2015 in Redondo Beach, Calif. on Mar. 10, 2015. This table also identifies the advantages and disadvantages of these various approaches. While water-based UV curable inks are not as susceptible to oxygen inhibition, these inks do not always produce vibrant images on the objects. Thus, non-aqueous UV curable inks would require one of the methods set forth in the above-identified article with the attendant disadvantages. Enabling DTO printers to cure non-aqueous UV curable ink images on 3D objects without the effects of oxygen inhibition and the disadvantages of known oxygen inhibition remedies would be beneficial.

SUMMARY

A new three-dimensional (3D) object printing system enables non-aqueous UV curable inks to be more completely cured. The printing system includes at least one printhead configured to eject drops of a non-aqueous ultraviolet (UV) curable marking material, a first member having a first end and a second end, the plurality of printheads being positioned between the first end and the second end of the first member, a holder configured to hold an object and to move along the member between the first end and the second end of the first member, a first actuator operatively connected to the holder, the actuator being configured to move the holder along the first member to enable the object to move past the printheads and receive marking material from the printheads in the plurality of printheads and form an ink image on the object, an ultraviolet (UV) curing device configured to emit UV light, the UV curing device being positioned between the plurality of printheads and the second end of the member to enable the UV curing device to cure the non-aqueous UV curable marking material ejected onto the object in the holder by the at least one printhead in the plurality of printheads, a vaporizer configured to form a vapor of a solution with a solvent and a particulate and direct the vapor toward the object in the holder, the vaporizer being positioned between the UV curing device and the at least one printhead, and a controller operatively connected to the at least one printhead, the first actuator, the UV curing device, and the vaporizer. The controller is configured to operate the first actuator to move the holder and object along the first member in a process direction, to operate the plurality of printheads to eject marking material onto the object and form the ink image on the object, to operate the vaporizer to form and direct the vapor toward the object in the holder to enable the vapor to condense on the ink image on the object, and to operate the UV curing device to direct UV light onto the ink image and the condensed vapor on the object.

A method of curing UV curable ink in a printer attenuates the effect of oxygen inhibition on non-aqueous UV curable inks to enable UV curable inks to be more completely cured in DTO printers. The method includes operating at least one printhead to eject drops of a non-aqueous UV curable ink onto a surface of an object, forming a vapor from a solvent, directing the vapor onto the drops of the non-aqueous UV curable ink on the surface of the object, and operating a UV light emitter to direct UV light onto the vapor and the drops of the non-aqueous UV curable ink on the surface of the object.

BRIEF DESCRIPTION OF THE DRAWINGS

The foregoing aspects and other features of a printing system and system for attenuating the effect of oxygen inhibition on the curing of non-aqueous UV curable ink are explained in the following description, taken in connection with the accompanying drawings.

DETAILED DESCRIPTION

Figure 1:
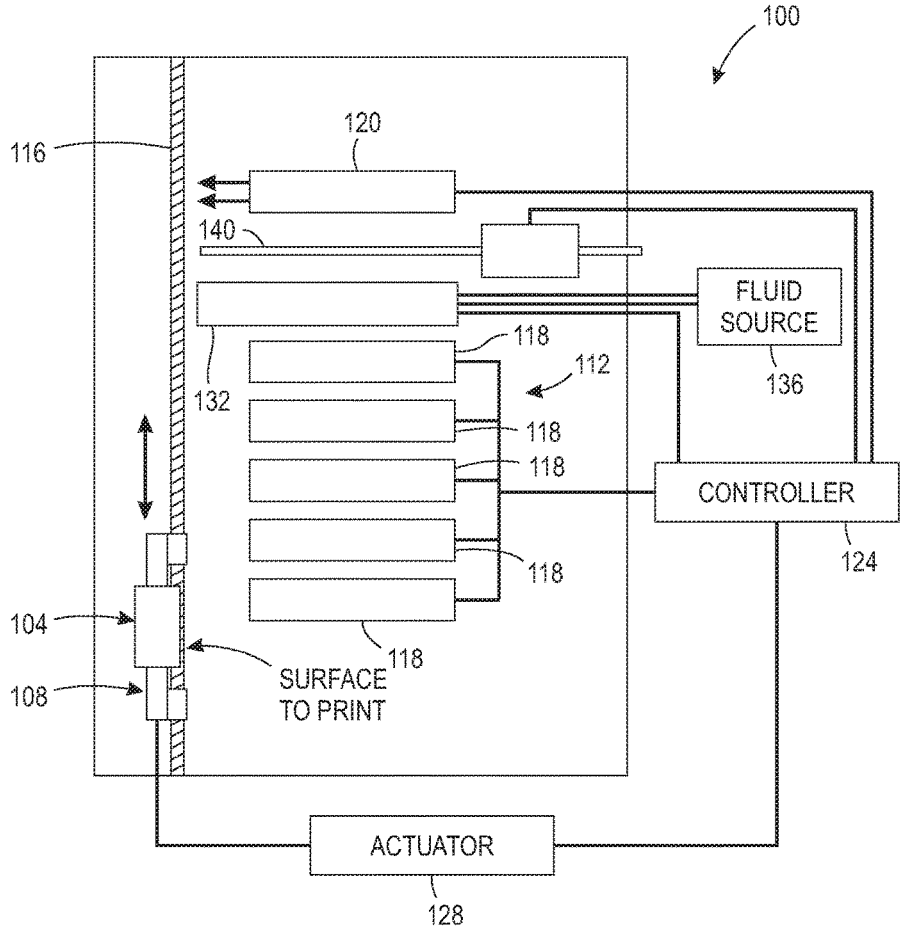
FIG. 1 is a schematic diagram of a side view of a DTO printing system having a system that attenuates the effect of oxygen inhibition on the curing of non-aqueous UV curable inks.

For a general understanding of the present embodiments, reference is made to the drawings. In the drawings, like reference numerals have been used throughout to designate like elements.

FIG. 1 depicts a direct-to-object (DTO) printing system 100 configured to print the surface of an object 104 secured with a holder 108 as the holder 108 moves the object 104 past an array 112 of printheads 118. The holder 108 is operatively connected to an actuator 128 so the controller 124 can operate the actuator to move the holder and the object bidirectionally along member 116 as indicated by the arrow in the figure. If one or more of the printheads 118 in the array 112 ejects ultraviolet (UV) marking material, then the UV curing device 120 is operated by controller 124 to direct UV light onto the ink image on the object 104 to cure the UV marking material in the image. Controller 124 is configured to operate the printheads 118 in the array 112 to eject marking material onto the surface of the object 104. As used in this document, "UV light" refers to light having a wavelength that is shorter than visible light, but longer than X-rays. The wavelength of such light is about 10 nm to about 400 nm. As used in this document, "printhead" means a component having at least two ejectors, each ejector being configured to propel drops of a marking material from the printhead.

To attenuate the effect of oxygen inhibition on the curing of non-aqueous UV curable marking material by the UV curing device 120, the system 100 includes a vaporizer 132. As noted previously, aqueous UV marking material is not susceptible to oxygen inhibition since the water in the marking material forms a water barrier to oxygen at the surface of the material. When non-aqueous UV marking material is used, however, a vaporizer configured as described in this document enables the non-aqueous UV marking material to be used and cured thoroughly. The vaporizer 132 is operatively connected to the controller 124 so the controller can operate the vaporizer 132 selectively. The vaporizer 124 is fluidically connected to a fluid source 136, which supplies a fluid solution to the vaporizer 132. The fluid solution is heated by the vaporizer 132 to produce a vapor that is directed by a pressurized air source within the vaporizer 132 toward the ink image on the object 104. A vapor removal device 140 is positioned between the vaporizer 132 and the UV curing device 120. The vapor removal device 140 is operatively connected to the controller 124 so the controller can operate the suction device to pull vapor from the vicinity of the object 104 that is not impinging on the surface of the object since this vapor does not contribute to the mitigation of the oxygen inhibition. The vapor pulled from the vicinity of the object surface is exhausted from the printer by the vapor removal device 140. The object 104 with the vapor impinging on its surface passes the UV curing device where the non-aqueous UV curable ink is cured by the UV light emitted by the UV curing device. As used in this document, the word "vaporizer" means a device that forms a vapor from a solution of solvent and particulate and directs the vapor onto an object surface where a portion of the vapor condenses on the object surface. The vapor removal device 140 can be a negative pressure or a positive pressure device. A positive pressure device, such as the fan in the vaporizer 132, dissipates uncondensed vapor in the vicinity of the object 104. A negative pressure device, such a vacuum, pulls uncondensed vapor into fluid path that can be exhausted outside of the housing 204. Depending on the type of solvent, a negative pressure device may be preferred so the captured vapor can be filtered or stored, rather than simply being dissipated from the printing environment.

Figure 2:
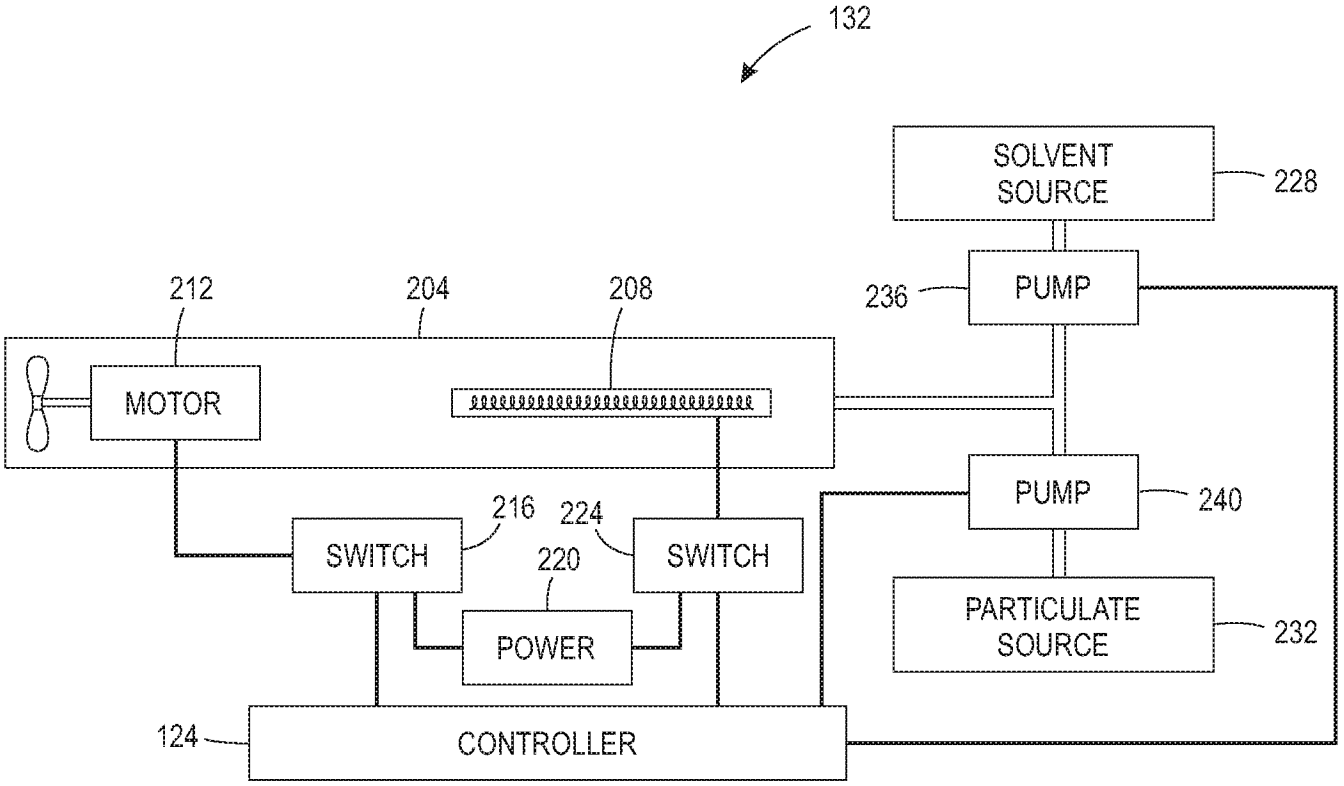
FIG. 2 depicts an embodiment of the system that attenuates the effect of oxygen inhibition on non-aqueous UV curable ink used in the printing system of FIG. 1.

FIG. 2 is block diagram of an embodiment of the vaporizer 132 that can be used in the printing system 100. The vaporizer 132 includes a housing 204 in which a heating element 208 and a source of pressurized air 212 are located. The source of pressurized air 212 is depicted as an electrical motor attached to a rotating fan in FIG. 2, but other embodiments of a pressurized air source can be used. An electrical switch 216 is operatively connected between an electrical power source 220 and the motor of the pressurized air source 212. The controller is operatively connected to the electrical switch 216 to operate the switch and connect electrical power to the motor selectively. In a similar manner, an electrical switch 224 is operatively connected between the electrical power source 220 and the heating element 208. The controller 124 is operatively connected to the electrical switch 224 to operate the switch and connect electrical power to the heating element 208 selectively.

The fluid source 136 includes a solvent source 228 and a particulate source 232 that are fluidically connected to the housing 204 to enable solvent and particulate from the two sources to flow together and then enter the housing 204. Each source includes a pump 236 and 240, respectively, that is operatively connected to the controller 124 to enable the controller to operate the pumps selectively and direct either solvent, particulate, or both into the conduit fluidically connected to the housing 204. The solution of the solvent and particulate are heated by the heating element 208 to form a vapor that is directed by the pressurized air source 212 toward the ink image on the object 104. A portion of the vapor condenses on the surface of the object 104 and the ink image on the object to form a barrier to oxygen inhibition. Once the ink image has been cured by the curing device 120, the controller 124 can operate the actuator 128 to return the holder 108 and the object 104 to its starting position. As the holder 108 and object 104 return to a position opposite the suction device 140, the holder 108 can be held in that position to enable the suction device 140 to remove any remaining uncondensed vapor at the surface of the object 104. Alternatively, the object can be removed from the holder by the operator and cleaned with an appropriate material.

Figure 3:
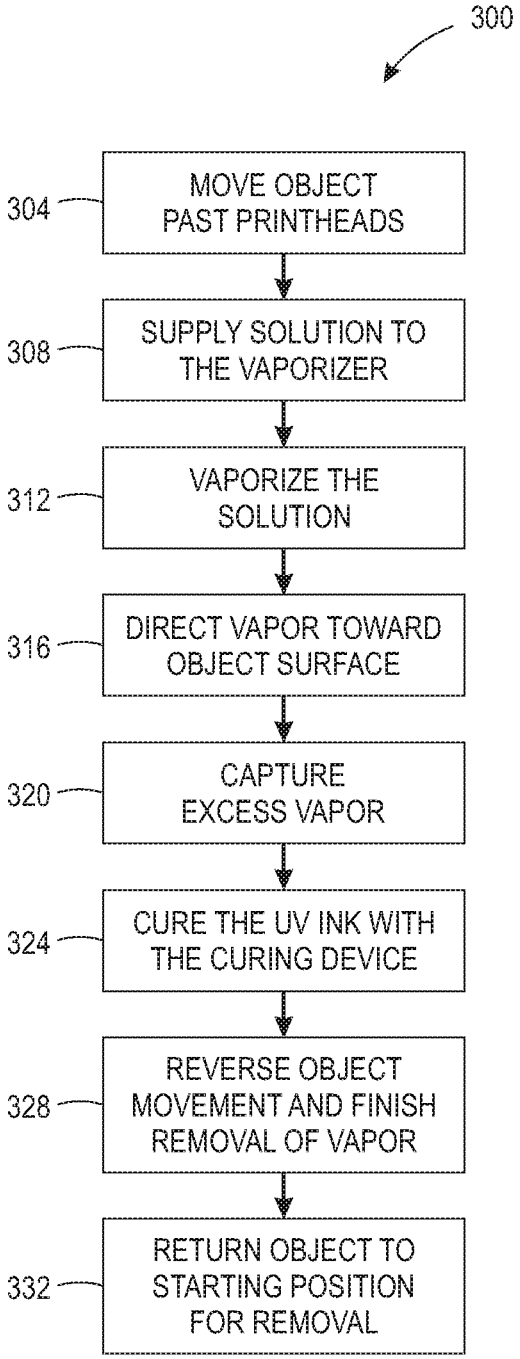
FIG. 3 depicts a process of operating a printer to attenuate the effect of oxygen inhibition on the curing of non-aqueous UV curable ink on a 3D object in a printer.

A process for operating the printer 100 is shown in FIG. 3. In the description of the process, statements that the process is performing some task or function refers to a controller or general purpose processor being configured with programmed instructions stored in non-transitory computer readable storage media operatively connected to the controller or processor that, when executed by the controller or processor, cause the controller or processor to manipulate data or to operate one or more components in the printer to perform the task or function. The controller 124 noted above can be such a controller or processor. Alternatively, the controller can be implemented with more than one processor and associated circuitry and components, each of which is configured to form one or more tasks or functions described herein. Additionally, the steps of the method may be performed in any feasible chronological order, regardless of the order shown in the figures or the order in which the processing is described.

FIG. 3 is a flow diagram of a process that attenuates oxygen inhibition of UV curable ink curing as described above. The process 300 begins by operating actuator 128 to move an object held by the holder 108 past the printhead array 112 and operating one or more of the printheads to form an ink image containing UV curable ink on the object (block 304). As the object is being printed, the controller operates the solvent source 228 and particulate source 232 to release particulate and solvent into the conduit connecting the two sources to form a solution that flows into the vaporizer (block 308). That solution is heated by the heating element 208 to form a vapor (block 312). The vapor is directed toward the object surface so some of the vapor condenses on the object (block 316) and, as the object continues past the vaporizer 132 and the suction device 140, the excess uncondensed vapor is captured or dissipated before the object reaches a position opposite the UV curing device 120 (block 320). When the object is opposite the UV curing device, the UV light from the curing device is able to cure the UV ink more thoroughly since the condensed vapor on the surface of the ink image attenuates oxygen inhibition of the curing process (block 324). After the image is cured, the operation of the actuator 128 is reversed by the controller 124 to return the holder 108 and the object past the suction device 140 to remove the condensed vapor from the surface of the object (block 328). Once the holder 108 and object 104 reach their original starting position, the object can be removed (block 332).

The solvent stored in the solvent source can be any suitable solvent for the particulate being stored in the particulate source. In one embodiment, the particulate is a salt and the solvent is water so the solution formed by the salt and water is a brine. Alternatively, the particulate may be small particles of solid matter that are not necessarily dissolved by the solvent. The adulterating particulate from the source 232, whether dissolved or not, helps reduce the surface tension of the solution and improve the wetting of the object surface with the vapor formed from the solution. As used in this document, the word "solution" means a mixture of a solvent and a particulate, which may or may not be dissolved completely or partially by the solvent. In another embodiment, the solvent source is a source of heated water and the particulate is a water-soluble wax. The vapor formed from the solution of the heated water and wax adheres more strongly to the object surface than the solutions disclosed above when the vapor condenses on the object. The solidified wax, however, must be removed from the object with isopropyl alcohol or some other appropriate solvent that releases the solidified wax from the object surface after the object is removed from the printer.

It will be appreciated that variations of the above-disclosed apparatus and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

The invention claimed is:

1. A printing system comprising:

at least one printhead configured to eject drops of a non-aqueous ultraviolet (UV) curable marking material;

a first member having a first end and a second end, the at least one printhead being positioned between the first end and the second end of the first member;

a holder configured to hold an object and to move along the first member between the first end and the second end of the first member;

a first actuator operatively connected to the holder, the actuator being configured to move the holder along the first member to enable the object to move past the printheads and receive marking material from the printheads in the plurality of printheads and form an ink image on the object;

an ultraviolet (UV) curing device configured to emit UV light, the UV curing device being positioned between the plurality of printheads and the second end of the member to enable the UV curing device to cure the non-aqueous UV curable marking material ejected onto the object in the holder by the at least one printhead in the plurality of printheads;

a vaporizer configured to form a vapor of a solution with a solvent and a particulate and direct the vapor toward the object in the holder to enable a portion of the vapor to condense on a surface of the object, the vaporizer being positioned between the UV curing device and the at least one printhead;

a vapor removal device positioned between the vaporizer and the UV curing device, the vapor removal device being configured to remove uncondensed vapor from a vicinity of the object after the portion of the vapor has condensed on the surface of the object and before the object is exposed to the UV light emitted by the UV curing device; and a controller operatively connected to the at least one printhead, the first actuator, the UV curing device, the vapor removal device, and the vaporizer, the controller being configured to operate the first actuator to move the holder and object along the first member in a process direction, to operate the plurality of printheads to eject marking material onto the object and form the ink image on the object, to operate the vaporizer to form and direct the vapor toward the object in the holder to enable the vapor to condense on the ink image on the object, to operate the vapor removal device to remove uncondensed vapor from the vicinity of the object before the object is exposed to UV light emitted by the UV curing device; and to operate the UV curing device to direct UV light onto the ink image and the condensed vapor on the object.

2. The printing system of claim 1, the vaporizer further comprising:

a heating element configured to heat the solution and form the vapor; and a source of pressurized air configured to direct the vapor toward the object.

3. The printing system of claim 2, the vaporizer further comprising:

a source of solvent;

a source of particulate; and a conduit fluidically connecting the source of solvent and the source of particulate to the vaporizer to enable particulate to mix with the solvent and form the solution prior to reaching the heating element.

4. The printing system of claim 1 wherein the vapor removal device is a positive pressure device.

5. The printing system of claim 1 wherein the vapor removal device is a negative pressure device.

6. A system for attenuating oxygen inhibition of ultraviolet marking material curing comprising:

a vaporizer configured to form a vapor of a solution with a solvent and a particulate and direct the vapor toward an object in a holder after an ink image has been formed on the object with at least one non-aqueous UV marking material to enable a portion of the vapor to condense on a surface of the object;

a vapor removal device configured to remove uncondensed vapor from a vicinity of the object after the portion of the vapor has condensed on the surface of the object and before the surface of the object is exposed to UV light; and a controller operatively connected to the vaporizer and the vapor removal device, the controller being configured to operate the vaporizer to form and direct the vapor toward the object in the holder to enable the vapor to condense on the ink image on the object and to operate the vapor removal device to remove uncondensed vapor from the vicinity of the object before the surface of the object is exposed to UV light.

7. The system of claim 6, the vaporizer further comprising:

a heating element configured to heat the solution and form the vapor; and a source of pressurized air configured to direct the vapor toward the object.

8. The system of claim 7, the vaporizer further comprising:

a source of solvent;

a source of particulate; and a conduit fluidically connecting the source of solvent and the source of particulate to the vaporizer to enable particulate to mix with the solvent and form the solution prior to reaching the heating element.

9. The system of claim 6 wherein the vapor removal device is a positive pressure device.

10. The system of claim 6 wherein the vapor removal device is a negative pressure device.

11. A method for operating a printer that forms ink images containing at least one non-aqueous ultraviolet (UV) curable ink on an object, the method comprising:

operating at least one printhead to eject drops of a non-aqueous UV curable ink onto a surface of an object;

forming a vapor from a solvent;

directing the vapor onto the drops of the non-aqueous UV curable ink on the surface of the object to enable a portion of the vapor to condense onto the drops of the non-aqueous UV curable ink;

operating a vapor removal device to remove uncondensed vapor from a vicinity of the object before the object is exposed to UV light; and operating a UV light emitter to direct UV light onto the vapor and the drops of the non-aqueous UV curable ink on the surface of the object.

12. The method of claim 11, the formation of the vapor further comprising:

dissolving particulate in the solvent to form a solution and forming the vapor from the solution.

13. The method of claim 11 wherein the operation of the vapor removal device includes operating a positive pressure device.

14. The method of claim 11 wherein the operation of the vapor removal device includes operating a negative pressure device.

15. The method of claim 12, the formation of the vapor further comprising:

heating the solution with a heating element to form the vapor; and directing the vapor toward the object with a pressurized air source.

16. The method of claim 15 further comprising:

delivering solvent from a source of solvent into a conduit;

delivering particulate from a source of particulate into the solvent within the conduit to form the solution; and delivering the solution to the vaporizer to enable the solution to be heated by the heating element.

17. The method of claim 11 further comprising:

operating a vapor removal device to remove condensed vapor from the surface of the object after the UV light emitter has directed UV light onto the drops of non-aqueous UV curable ink on the surface of the object.

* * * * *